US006360984B1

(12) United States Patent
England

(10) Patent No.: US 6,360,984 B1
(45) Date of Patent: Mar. 26, 2002

(54) FIELD FENCE UNROLLER AND STRETCHER

(76) Inventor: Phillip T. England, 295 Sycamore Rd., Dickson, TN (US) 37055

( * ) Notice: Subject to any disclaimer, the term of this patent is extended or adjusted under 35 U.S.C. 154(b) by 0 days.

(21) Appl. No.: 09/354,125

(22) Filed: Jul. 15, 1999

(51) Int. Cl.[7] ..... B65H 16/02
(52) U.S. Cl. ..... 242/557; 242/598.5; 256/37
(58) Field of Search ..... 242/557, 298.3, 242/598.5, 403, 396.5, 397, 125.2, 580; 256/37

(56) References Cited

U.S. PATENT DOCUMENTS 2,859,944 A * 11/1958 Cisney ..... 256/37
3,048,348 A * 8/1962 Griffin ..... 242/403 X
3,243,141 A * 3/1966 Cook et al. ..... 242/557 X
3,570,731 A * 3/1971 Waltz ..... 242/557 X
4,930,718 A * 6/1990 Lancour et al. ..... 242/557
5,163,634 A * 11/1992 Moon et al. ..... 242/557 X
5,582,216 A * 12/1996 Smith et al. ..... 242/557 X
6,042,046 A * 3/2000 Beyer, Sr. ..... 242/557 X

FOREIGN PATENT DOCUMENTS

CA 177460 * 6/1917 ..... 242/396.5

* cited by examiner

*Primary Examiner*—William A. Rivera
(74) *Attorney, Agent, or Firm*—Harry I. Leon

(57) ABSTRACT

An apparatus for handling woven wire fencing which in use is attached to a farm tractor. Disposed vertically between upper and lower horizontal framing members within a rectangular frame are a removable shaft, a hinged gate, and a vertical guide bar. The shaft is used to hold the roll of woven wire fencing uprightly atop the metal disk. In use, the wire fencing is simultaneously unrolled and pulled rearwardly through the nearly-closed gate, straightening the fencing material. Guide rails within the gate direct the fencing material towards a pair of horizontal fingers, each rigidly connected to the vertical guide bar and the rear vertical frame member. Once enough fencing material has been unrolled to span at least the distance between two fence posts, the gate is swung shut, clamping the wire against the rear vertical frame member.

4 Claims, 5 Drawing Sheets

FIELD FENCE UNROLLER AND STRETCHER

FIELD OF INVENTION

This invention is in the art of woven fence wire handling and installing equipment.

BACKGROUND

Interest in apparatus which is attachable to a farm tractor for handling rolled woven wire fencing is evident as far back as 1959. In that year, Parker and Taylor patented a rather complicated apparatus capable of picking up a roll of woven fence wire on the ground and then rotating it into a vertical position. As also disclosed by Parker and Taylor in U.S. Pat. No. 2,914,270, a tractor's power take-off can be used to turn the roll so as to stretch the wire during installation.

Griffin, U.S. Pat. No. 3,048,348, which issued Aug. 7, 1962, discloses a fence stringing and stretching implement which provides a frame on which a reel of woven fence wire is mounted and a hydraulic cylinder which provides the force for stretching the woven fence wire.

Holub, U.S. Pat. No. 2,416,585, which issued Feb. 25, 1947, discloses a reel for fence wire which is mounted on a drawbar of a tractor. Holub uses a spring bias arm for stretching the wire.

Moon et al., U.S. Pat. No 5,163,634, disclose a fence stretching apparatus also mounted on the rear of a tractor. In Moon's combination, a reel of fencing material is held by a shaft in a vertical position in a triangular frame; and an hydraulic cylinder is used to stretch the fencing material just prior to securing it to the fence post.

SUMMARY OF THE INVENTION

The primary object of the present invention is to provide an improved fence handling and installing apparatus which is low in cost and easy to use both in open fields and in wooded areas, A further object of the present invention it to provide such an apparatus which does not require the use of an hydraulic cylinder in order to stretch woven fence wire. Not only is the cost lowered when an hydraulic cylinder is no longer needed but also its elimination simplifies the installation of the apparatus on a tractor.

A still further object is to provide an improved fence handling and installing apparatus which, during the installation process, straightens the wire fencing, overcoming its natural tendency to roll up again;

In accordance with the present invention, there is provided a tractor-pulled apparatus having a rectangular frame, a hinged gate and structures rigidly attached to the frame for guiding wire fencing as it is being pulled through the gate, while it is partially open, from a roll mounted on a shaft within the apparatus. The gate and guiding structures help to straighten the wire fencing and keep it from reverting to a curved shape as it is being unrolled. The stretching of the fencing material is accomplished by attaching a section of wire fencing, which has been pulled rearwardly of the gate, to a fence post, locking the gate so as to prevent any further discharge of wire fencing therethrough, and then moving the tractor slowly forward until the desired amount of tension has been applied to the wire fencing.

DETAILED DESCRIPTION OF THE PREFERRED EMBODIMENT

Figure 1:
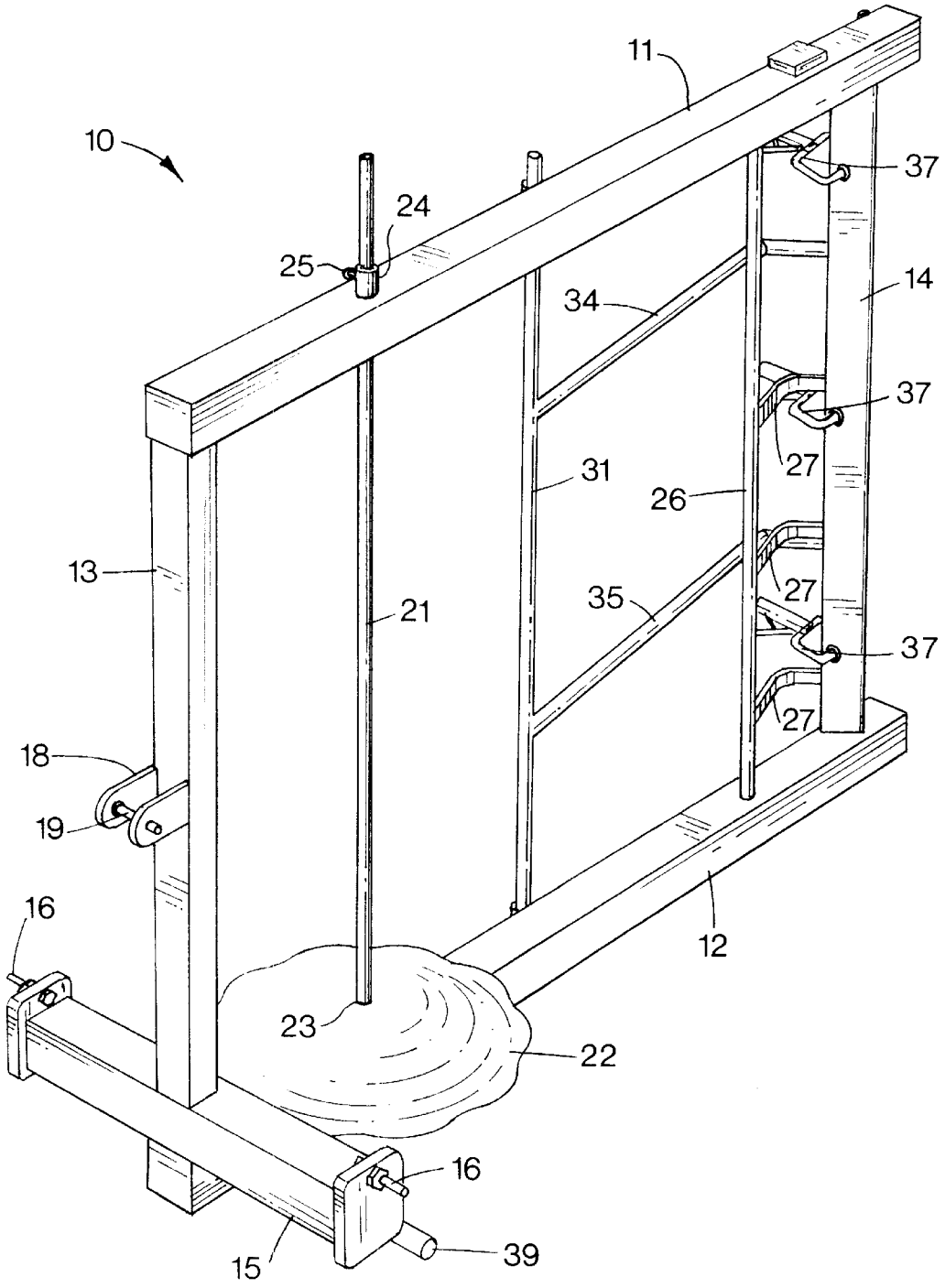
FIG. 1 is a right side frontal perspective view of the field fence unroller and stretcher apparatus according to the present invention.
Figure 2:
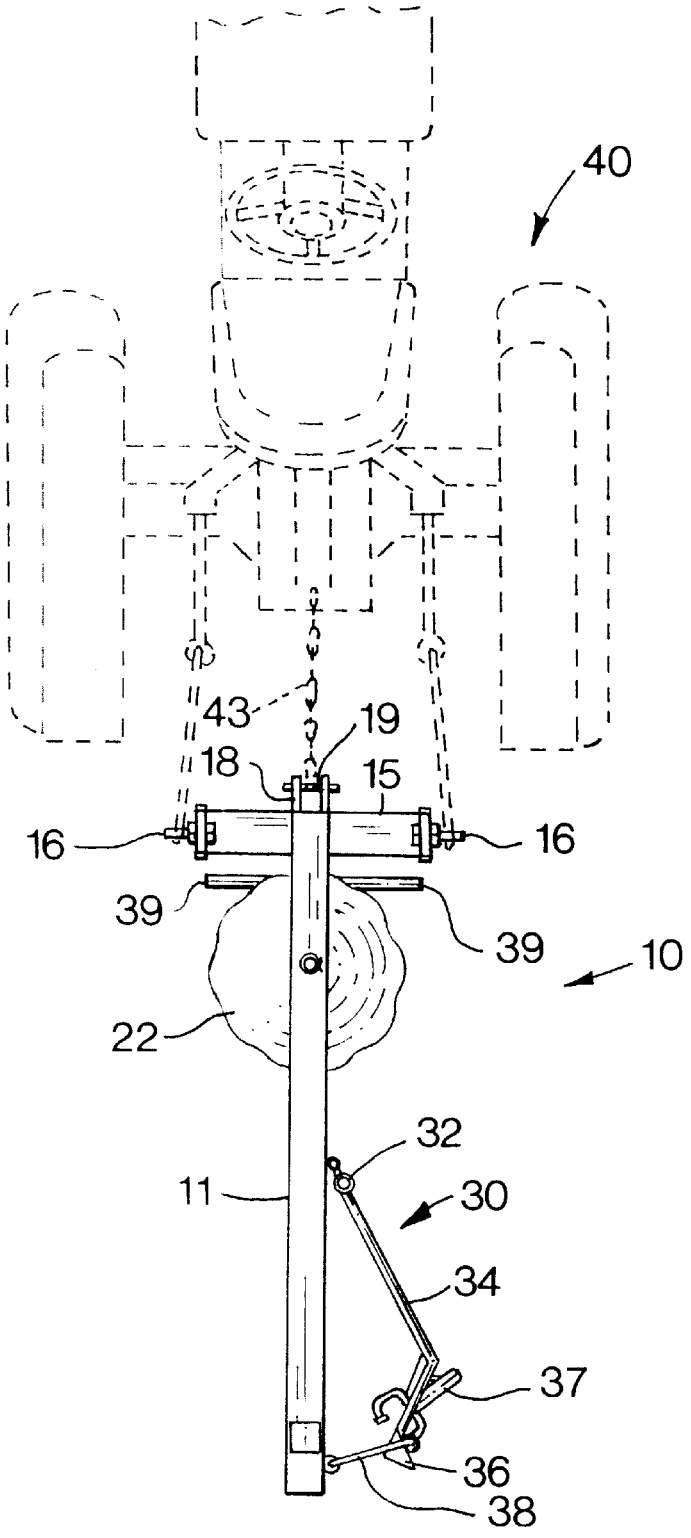
FIG. 2 is a top plan view of the apparatus according to FIG. 1, the apparatus being shown in position to be pulled by a farm tractor, the tractor, which forms no part of the claimed invention, being shown in dashed lines for illustrative purposes only.

Referring now to the drawings, an improved fence handling and installing apparatus, indicated generally by the reference numeral 10, comprises a generally rectangular frame having upper and lower horizontal frame members 11, 12, as well as front and rear vertical frame members 13, 14, and a hinged gate 30 (FIGS. 1 and 2). In the preferred embodiment, the upper and lower horizontal frame members 11, 12 are made from 4×4 inch square, hollow metal sections with ¼ thick walls; each frame member 11, 12 measures, by way of example, about 6 feet in length and is spaced apart from the other a distance of about 5 feet. The front and rear vertical frame members 13, 14, on the other hand, are fabricated, respectively, from a 3×3 inch square, hollow section and a 3×3 inch angle section, both with ¼ inch thick walls.

With its mid-section disposed contiguous with the lower end of the front vertical frame member 13, a cross beam 15 extends perpendicularly to and laterally from the lower horizontal and front vertical frame :members 12 and 13 (FIGS. 1 and 2). Rigidly attached to both frame members 12, 13, the cross beam 15 includes mounting pins 16, which extend laterally from distal ends of the beam 15. The pins 16 are provided so that the beam can be easily attached to a tractor 40 with a three-point hitch (FIG. 2). In the preferred embodiment, the total length of the cross beam 15 measures, by way of example, about 26 inches. The pins 16, which are preferably category 1 or 2 pins, measure about 5 inches in length and about 1 inch in diameter.

The apparatus 10, which is otherwise free to rotate about the pins 16, also features a bracket 18 located about midway up the front side of the vertical frame member 13 (FIG. 1). Used, alternately, to stabilize the rectangular frame or to rotate it either upwardly or downardly about the pins 16, the bracket 18 holds a pin 19 to which a chain 43 or hydraulic cylinder (not shown) linked to the tractor 40 can be attached (FIG. 2). When a tension force is applied to the bracket 18, the rear of the apparatus 10 tends to rotate upward.

Figure 3:
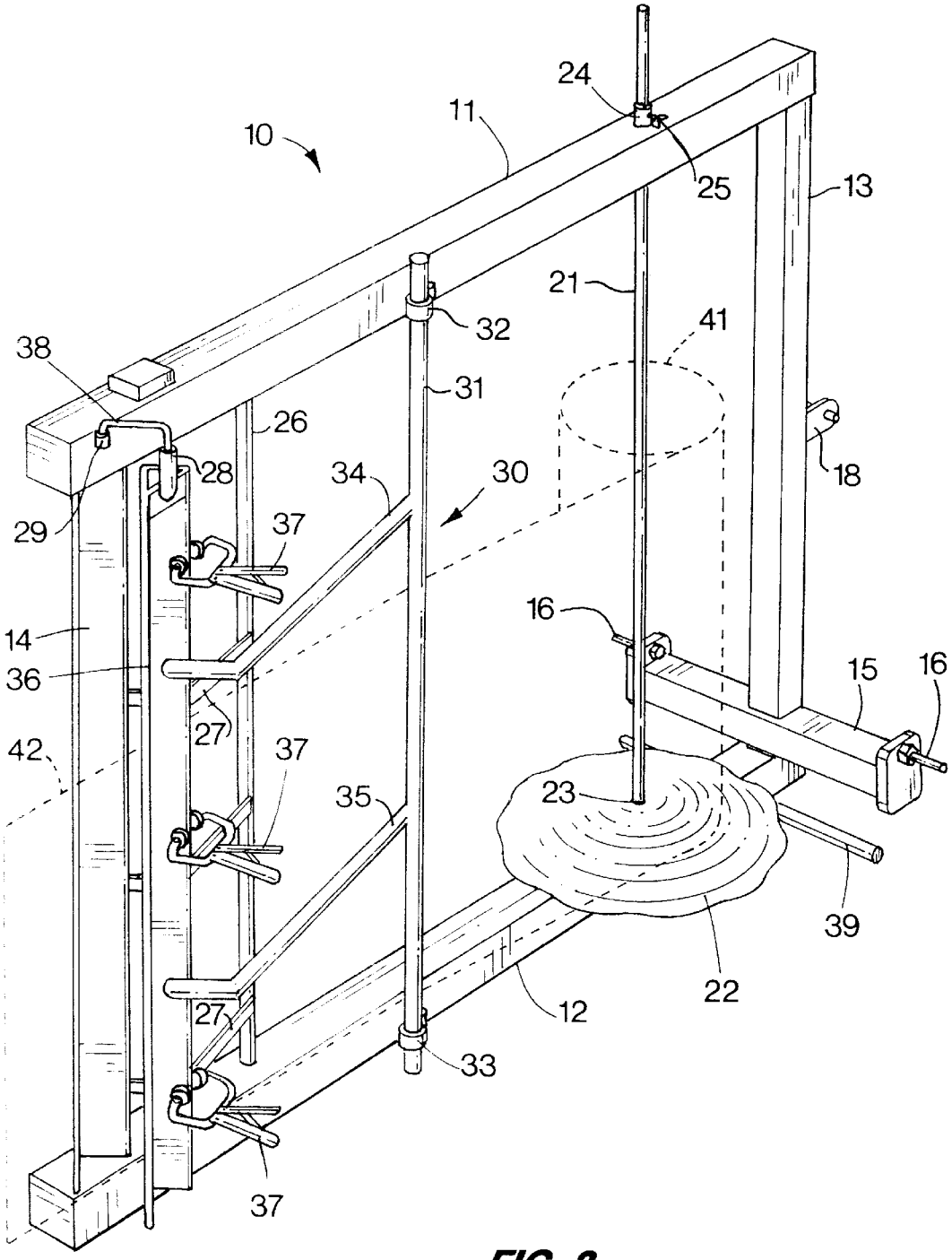
FIG. 3 is a left side rear perspective view of the apparatus according to FIGS. 1, in which a gate therein is partially open and a roll of wire fencing material held in the apparatus is being unrolled and fed through the gate, the wire fencing which does not form part of the claimed invention being shown in dashed lines for illustrative purposes only.
Figure 4:
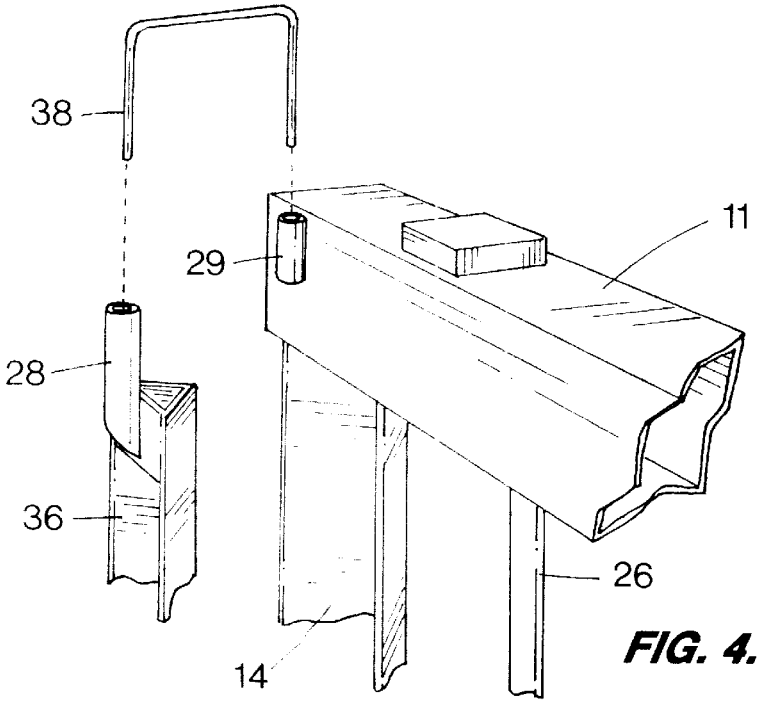
FIG. 4 is an exploded view, on an enlarged scale, of a fragmentary portion of the apparatus according to FIG. 1, showing a portion of the gate.

Holding a roll 4 of woven fence wire 42 in an upright position between the upper and lower frame members 11, 12 is a removable shaft 21 arid a circular disk 22 fixedly attached to the lower frame member (FIG. 3). The disk 22, which serves as a platform on which to rest the roll 41, preferably measures about 22 inches in diameter. A collar 24, through which the shaft 21 can be slid, is attached to the upper surface of the frame member 11 and is aligned with an opening formed therein and with a hole 23 in the disk 22 (FIGS. 1 and 3). Both the opening in the frame member 11 and the hole 23 are sized to slideably receive the shaft 21. In the preferred embodiment, the opening and the hole 23 aligned therewith, as well as the shaft 21, measure, by way of example, approximately 1 inch in diameter. In an alternate embodiment, in which the disk 22 is not welded or otherwise rigidly attached to the lower horizontal frame member 12, a hole formed therein of approximately the same size as the hole 23 and disposed directly beneath it is also provided. A pinch bolt 25, which threadedly engages the collar 24, is employed to hold the shaft 21 in a fixed position.

In preparation for use, the shaft 21 is raised upwardly through the collar 24 until its lower end is high enough above the disk 22 for one to place a roll 41 of woven fence wire 42 in an upright position on this disk, The shaft 21 is then lowered through the collar 22 and into the hollow core (not shown) of the roll 42. Once the lower end of the shaft 21 has been inserted into the hole 23, a pinch bolt 25 on the collar 22 can be tightened, securing the upper end of the shaft (FIG. 3).

In order to control the escape of wire 42 from the roll 41, a gate 30 is incorporated into the apparatus 10, as shown in FIGS. 1 through 6. The gate 30 includes a riser 31, an elongated closure bar 36 spaced apart from the riser, and two horizontal guide rails 34, 35. Both the rear vertical frame member 14 and the closure bar 36 are fabricated from angle bar stock (FIG. 3). Distal ends of the guide rails 34, 35 are affixed to the riser 31 and closure bar 36 (FIG. 3). Hinges 32 and 33 mounted on the upper and lower frame members 11 and 12, respectively, pivotally connect the riser 31 to the rectangular frame (FIG. 3).

Means for holding open the gate 30 includes sleeves 29, 28 rigidly attached to the upper horizontal frame member 11 and the closure bar, respectively, and a removable, U-shaped spacer 38 which can be slideably inserted into both sleeves at once. In use, the gate 30 is held open by the spacer 38 while wire 42 is pulled from the roll 41 and passed rearwardly between the horizontal frame members 11, 12 (FIG. 3).

Figure 5:
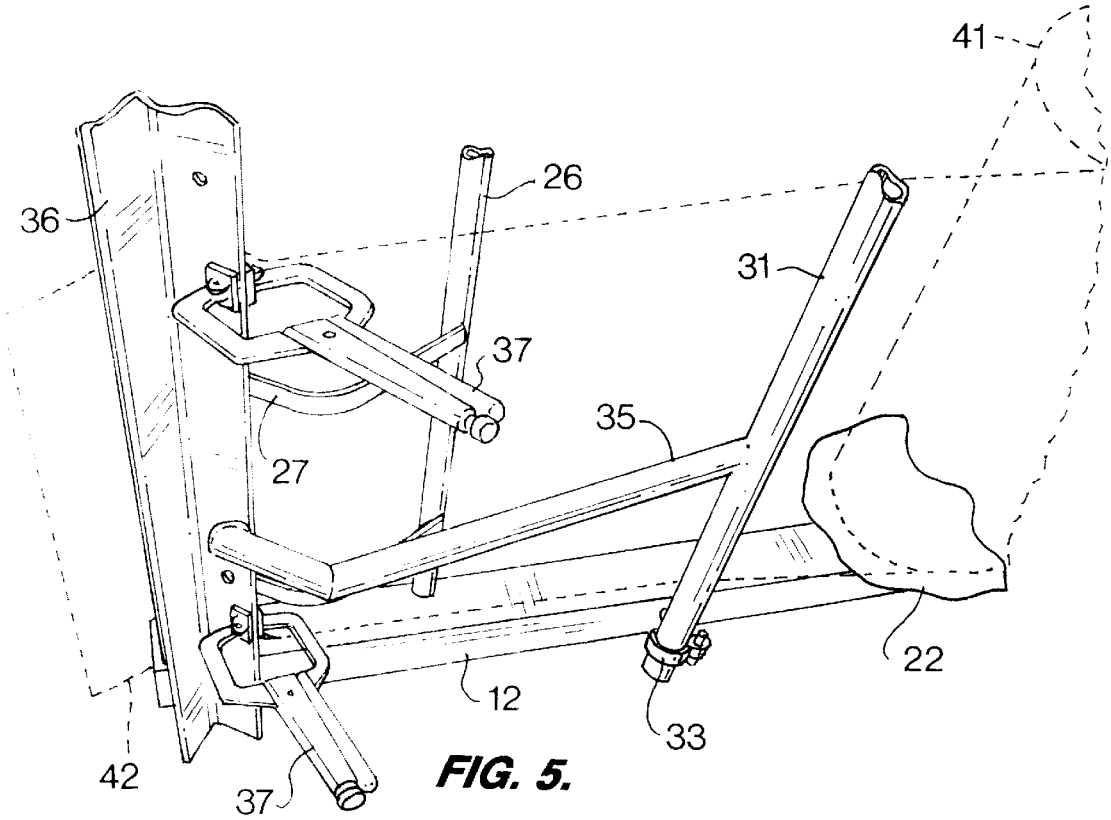
FIG. 5 is a left: side rear perspective view, on an enlarged scale, of a fragmentary portion of the apparatus according to FIG. 1, in which a gate closure bar and a vertical framing member therein are clamped together so as to hold a segment of wire fencing securely in place and prevent further unrolling of a roll of woven fence wire mounted in the apparatus, the wire fencing and roll, which do not form any part of the claimed invention, being shown in dashed lines for illustrative purposes only.
Figure 6:
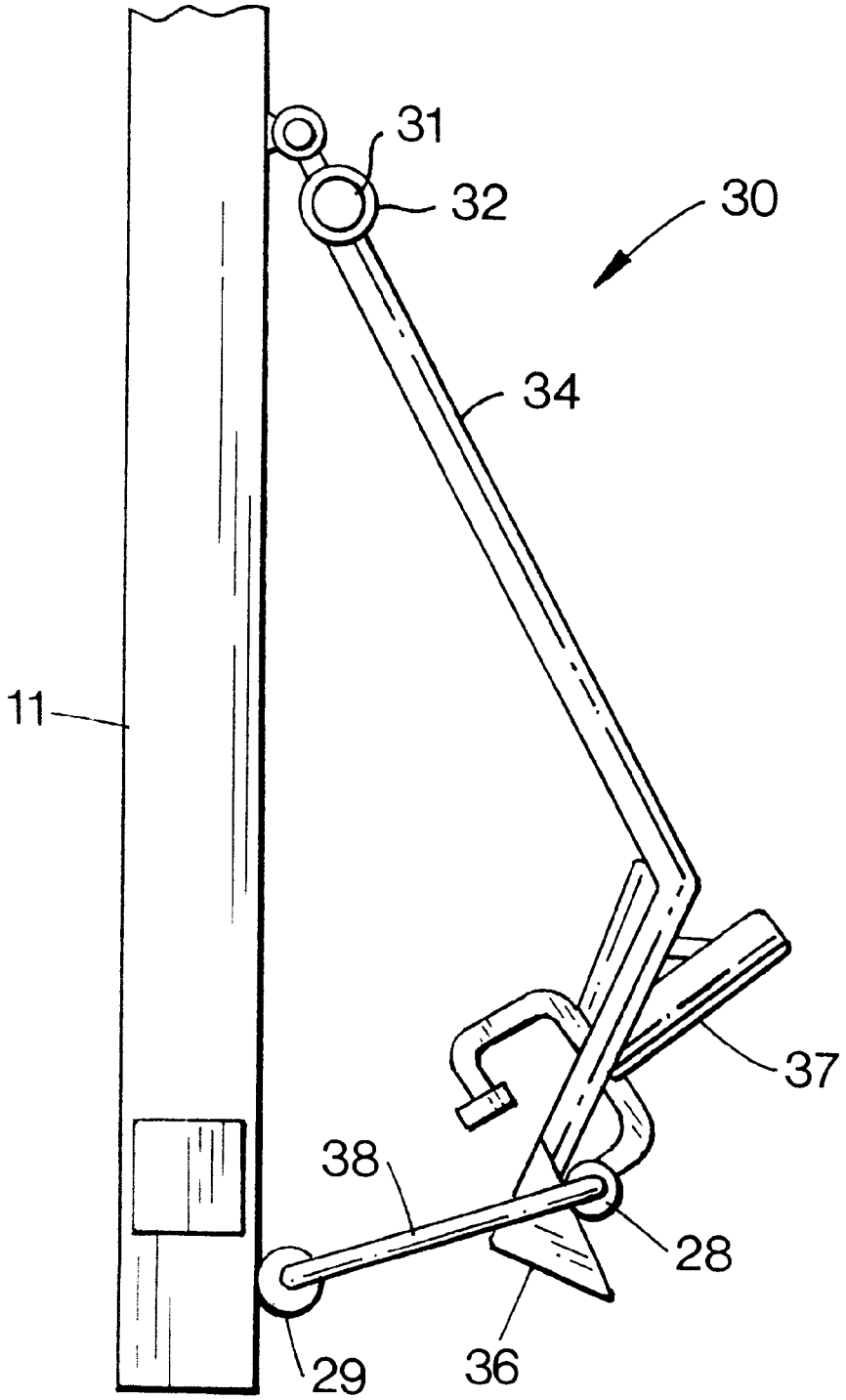
FIG. 6 is a top plan view, on an enlarged scale, of a fragmentary portion of the apparatus according to FIG. 1.

Means for straightening the wire 42 as it is being pulled from the roll 41 includes a guide bar 26, the rear vertical frame member 14 and a plurality of horizontal fingers 27 which connect them, as well as the gate 30 (FIGS. 1, 3 and 5). With the gate 30 partially ajar, the guide bar 26 directs the fencing material 42, which otherwise has a tendency to curl back on itself as it is being unrolled, into an elongated vertical's lot between the vertical frame member 14 and the gate closure 36 (FIG. 3).

When the desired amount of fencing material 42 has been discharged, the spacer 38 is removed; and the gate 30 is rotated about the hinges 32, 33 so as to bring the gate closure bar 36 into abutment with the vertical frame member 14. In this closed position, with the closure bar 36 partially nested within the rear vertical frame member 14, the gate 30 is clamped shut (FIG. 5). In the embodiment illustrated in FIG. 5, this clamping is accomplished by squeezing the vertical frame member 14 between the closure bar and one jaw of each of a plurality of locking pliers 37, where each pair of pliers has an opposing jaw rigidly affixed to the closure bar 36 itself.

As the gate closure 36 presses against the vertical frame member 14, the latter puts a small crease in the wire 42. This small crease keeps the wire 42 from slipping out of the closed gate 30 when the tractor 40 is subsequently used to stretch the wire between a pair fence posts. Moreover, the apparatus 10 can form this crease in woven fencing material 42 fabricated from any one of a wide variety of weaves as well as from wire in a range of gauges.

A summary of the steps involved in a fencing operation using the apparatus 10 is as follows:

1. A roll 41 of woven wire fencing 42 is secured in an upright position atop the disk 22 with the use of the shaft 21.
2. A tractor 40 is driven to the approximate location of the start of a line of fence posts.
3. The U-shaped spacer 38 is installed to hold the gate 30 open.
4. A few yards of the fencing material 42 is pulled from the roll 41 as it turns on the disk 22 about the shaft 21.
5. The fencing material 42 is attached in the normal manner to the first fence post.
6. The tractor 40 is then driven forward to the second fence post as the fencing material 42 simultaneously unrolls.
7. The fencing material 42 is brought manually over to the second fence post.
8. The gate 30 on the apparatus 10 is locked to prevent any additional fencing material 42 from escaping therefrom.
9. The tractor 40 is then driven forward slightly toward the third fence post, until sufficient tension has been put on the fencing material 42 so that it can be attached to the second fence post.
10. The gate 30 is again opened and the tractor 40 is driven to the third fence post.
11. Steps 7 through 10 are repeated for each additional fence post.

The apparatus 10 can be used to install fencing through a forest or brush area without performing extensive clearing. All that is needed is a foot path along the fence line and the capacity to drive a tractor 40 next to a part of the fence line. To use the apparatus 10 in such a situation, a fence installer positions the tractor 40 as close to the fence line as possible and then pulls fencing material 42 manually from the roll 41. Then, holding the wire, he walks on the foot path along the fence line until he reaches a suitable fence post on which to attach the fencing., Next the fence installer closes the gate 30 and drives the tractor 40 forward, stretching the wire 42.

When the apparatus 10 is not mounted on a tractor 40, feet 39 attached to the bottom surface of the lower horizontal frame member 12 stabilize the apparatus 10, so that it can stand vertically in storage.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. An apparatus for handling a roll of woven fence wire, unrolling the wire and stretching it during installation, comprising:

(a) a generally rectangular frame having upper and lower horizontal frame members, which are spaced apart, and front and rear vertical frame members;

(b) a platform :mounted atop the lower frame member, the platform being sufficiently large in size to hold the roll of woven fence wire in an upright position;

(c) the platform and the upper frame member defining first and second holes, respectively; the first and second holes being aligned vertically with each other;

(d) a removable shaft which is slip-fitted into said first and second holes, the shaft, when so slip-fitted, spanning at least a distance from the upper horizontal frame member to said first hole, so that the roll of woven wire can be placed upright on the platform and held in position by the shaft;

(e) means for temporarily clamping a segment of woven fence wire across its entire transverse width against the rear vertical frame member, so that unrolling of the roll of wire held by the shaft can be temporarily halted wherein said means is pivotally connected about a vertical axis.

2. The apparatus according to claim 1 wherein the means for temporarily clamping said segment of woven fence wire further comprises a gate having an elongated closure bar, the closure bar being partially nested within the rear vertical frame member when the gate is clamped shut, so that when the closure bar is pressed against the vertical frame member, a small crease is formed in the woven fence wire, thereby preventing the wire from slipping out of the gate when the apparatus is being moved forward.

3. An apparatus, mountable on a farm tractor, adapted for handling rolled woven fence wire, unrolling the wire and stretching it from a first fence post to which the wire has been already been attached to a second fence post, which comprises:

(a) a generally rectangular frame having upper and lower horizontal frame members, which are spaced apart, and front and rear vertical frame members;

(b) a platform mounted atop the lower frame member, the platform being sufficiently large in size to hold the roll of woven fence wire in an upright position;

(c) the platform and the upper frame member defining first and second holes, respectively; the first and second holes being aligned vertically with each other;

(d) a removable shaft which is slip-fitted into said first and second holes, the shaft, when so slip-fitted, spanning at least a distance from the upper horizontal frame member to said first hole, so that the roll of woven wire can be placed upright on the platform and held in position by the shaft;

(e) means for temporarily clamping a segment of woven fence wire across its entire transverse width against the rear vertical frame member wherein said means is pivotally connected about a vertical axis, so that unrolling of the roll of wire held by the shaft can be temporarily halted whenever the tractor is moved in a direction away from the first fence post and toward the second fence post.

4. The apparatus according to claim 3 wherein the means for temporarily clamping said segment of woven fence wire further comprises a gate having an elongated closure bar, the closure bar being partially nested within the rear vertical frame member when the gate is clamped shut, so that when the closure bar is pressed against the vertical frame member, a small crease is formed in the woven fence wire, thereby preventing the wire from slipping out of the gate when the apparatus is being moved forward.

* * * * *